United States Patent [19]

Wolf

[11] Patent Number: 4,597,748

[45] Date of Patent: Jul. 1, 1986

[54] METHOD AND APPARATUS FOR FORMING GAUZE PADS

[76] Inventor: Robert A. Wolf, Colvintown Rd., Coventry, R.I. 02816

[21] Appl. No.: 657,804

[22] Filed: Oct. 4, 1984

[51] Int. Cl.[4] ..... B65H 45/09; B65H 45/105

[52] U.S. Cl. ..... 493/29; 493/357; 493/413; 493/458

[58] Field of Search ..... 493/10, 27, 29, 30, 493/33, 357, 413, 414, 446, 23

[56] References Cited

U.S. PATENT DOCUMENTS

| | | | |
|---|---|---|---|
| 124,044 | 2/1872 | Farwell | 493/413 |
| 483,735 | 10/1892 | Clark | 493/413 |
| 2,020,668 | 11/1935 | Wandel | 493/413 |
| 2,098,427 | 11/1937 | Menschner | 493/413 |
| 3,495,819 | 2/1970 | Davidson | 493/30 |
| 3,627,306 | 12/1971 | Affupper | 493/413 |
| 4,030,720 | 6/1977 | Jones | 493/30 |
| 4,068,566 | 1/1978 | Joice | 493/29 |
| 4,070,951 | 1/1978 | Bala | 493/29 |

FOREIGN PATENT DOCUMENTS

| | | | |
|---|---|---|---|
| 47896 | 5/1911 | Austria | 493/414 |
| 177856 | 10/1983 | Japan | 493/27 |
| 12566 | of 1910 | United Kingdom | 493/413 |

*Primary Examiner*—Lowell A. Larson
*Assistant Examiner*—William E. Terrell
*Attorney, Agent, or Firm*—Barlow & Barlow

[57] ABSTRACT

Gauze pads ready for packaging are formed by drawing web material from a roll and then folding the same longitudinally into a vertical attitude. Nip rolls driven at a controlled rate, draw the web from a folding station and then into an air stream which is directed horizontally at the vertical web where a tensionless loop is maintained. The web then passes through a vertical support guide and then to a folding station where reciprocating blades push the web alternately right and left, the alternations being held against side plates by flexible wire pads to prevent the fold from being pulled out by the next alternation of direction. The folded web is then pushed past a cutter by successive alternations of added material, the now cut pads being further pushed into diverging trays for packaging.

2 Claims, 4 Drawing Figures

METHOD AND APPARATUS FOR FORMING GAUZE PADS

BACKGROUND OF THE INVENTION

Gauze pads, when packaged, consist essentially of at least a double layer of non-woven web that is folded at least once. Various techniques have been utilized to make up gauze pad packages. Many of the prior attempts have been slow and cumbersome. For example, rollers have been used to fold a web, but they do not provide the necessary accuracy of folds.

SUMMARY OF THE INVENTION

The present invention is a gauze pad folding, cutting and packaging method and apparatus, wherein a roll of gauze or web textile material is processed from unwinding to packaging through a series of steps. The apparatus is constructed first to take the web and fold it longitudinally in a vertical configuration, and then feed it into some nip rolls and thence into an accumulator; and then it is folded in a multi-pleated accordion fold; and finally it is cut vertically at the horizontal midportion of the accordion fold, and the individual pads, which may be 2×4, 3×4, or 4×4, depending upon the size of the web and width of the folding plates are packed into an open-ended tray so as to permit bagging in quantities. The folding plates are interchangeable for making other size pads. The apparatus is constructed so that the unwinding of a roll of gauze may be maintained at whatever speed between minimum and maximum the operator desires.

More particularly, a web is drawn from a roll and into a folding station where the web is folded longitudinally and oriented in a vertical attitude. The web is then drawn from the folding station between a pair of controlled speed feed rolls; and thence into an air stream which is directed horizontally at the vertical web. At this station a nearly tensionless loop is maintained. From this position the web passes through a U-shaped vertical support guide. A sensing means is built into the accumulator where the loop is maintained and adjusts the speed of the feed rolls to maintain the proper loop. The U-shaped support guide is maintained on an operating rod of a solenoid so that after a predetermined number of folds are made in a subsequent station, the guide may be kicked upwardly a sufficient height to provide among the pads at the output end of the mechanism a visual indicator of, for example, the one hundredth pad, or any pre-chosen number. From the guide, reciprocating blades push the web as it emerges alternately right and left. The resulting alternations are held against side plates by flexible wire pads to prevent the fold from being pulled out by the next alternation direction in the folding motion. As the alternating folds are continued, an accordion pleat is achieved, and this is pushed past a knife-edged saw blade that is vertically centered between the walls of the receiving tray into which the web, now folded, has been pushed by incoming folds. One cut the square dimension pads are pushed into diverging trays so that properly sized paper bags may be slid over the tray, and enabling the operator to separate the pads to kicked up indicated portions and push the pre-counted portions into subsequent off-site sealing, sterilizing and packing equipment.

It is the principal object of this invention to provide a gauze pad folder which operates upon a previously unwound web to form the web into neat, even and continuous accordion pleats, delivered into an open-ended receiving chute or tray.

Another object of the invention is to provide a folding and cutting apparatus which can be converted easily from one dimension to another, saving capital costs and floor space, and allowing for flexibility in production scheduling.

DETAILED DESCRIPTION OF THE PREFERRED EMBODIMENT

Figure 1B:
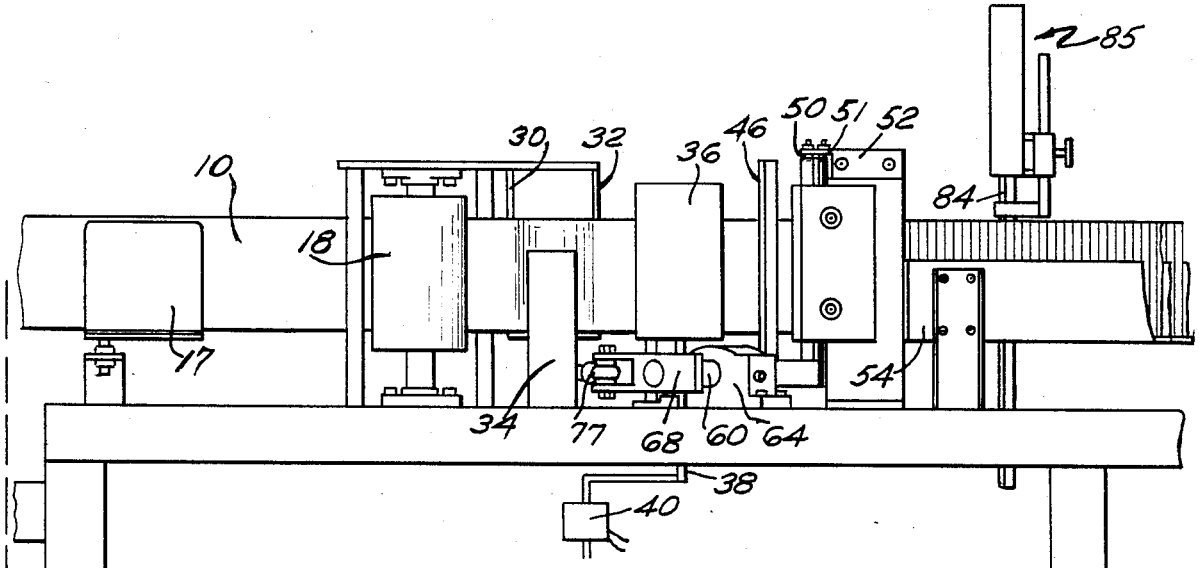
FIGS. 1A and 1B are vertical elevational views of the mechanism of the invention illustrating the method of taking a web and folding the same into pads.
Figure 1A:
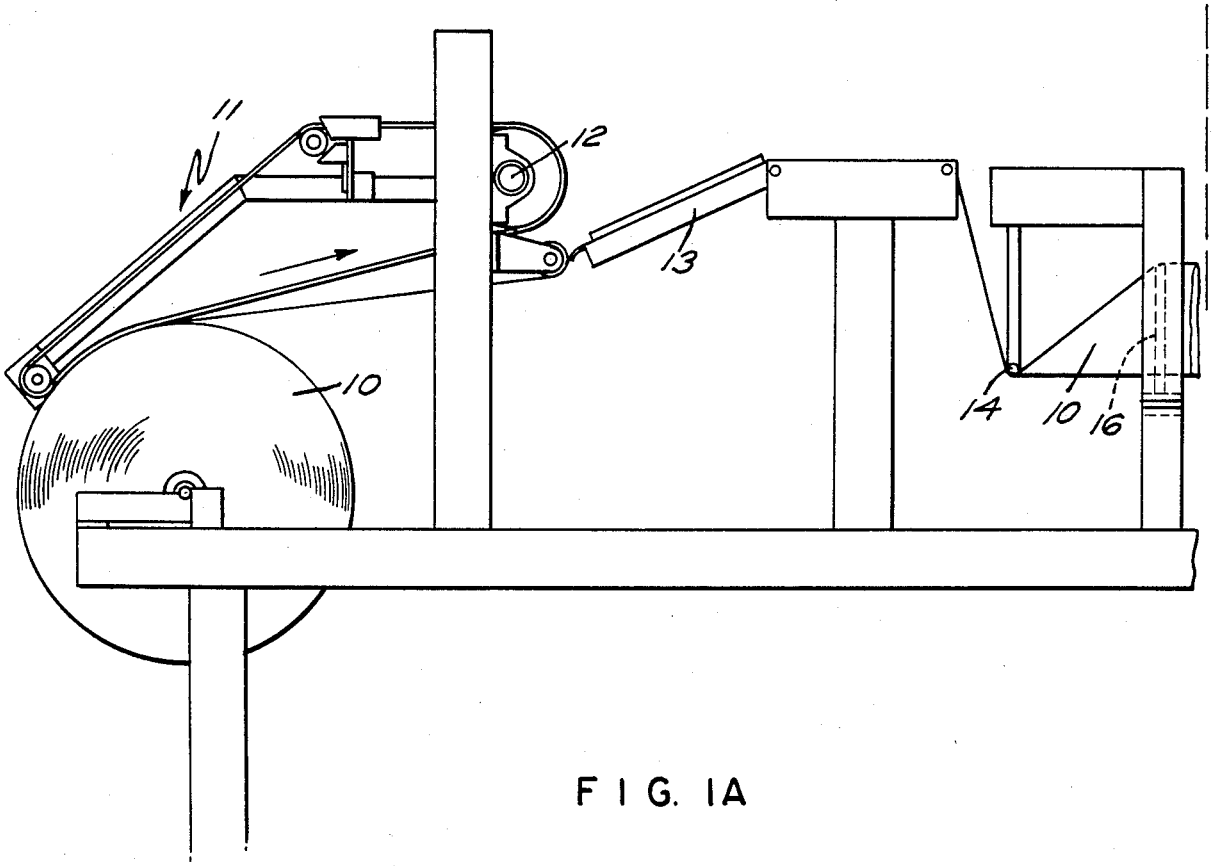

Referring now to the drawings, and more particularly to FIGS. 1A and 1B, a roll of fabric such as 10 is drawn off the roll by a tractor drive 11 driven by a motor (not shown) coupled to shaft 12, led over a guide table 13, and thence down under a guide bar 14 where a vertical folding guide 16 takes the horizontal web and places it into a folded vertical attitude. The folded web is guided by U-shaped guide 17, then measuredly advanced by feed rolls 18 and 20 which are spring-loaded (not shown) toward each other; and these feed rolls are driven by a motor 22 through a drive mechanism 24, indicated diagramatically by a dotted line. The speed of the motor is in turn controlled by a speed control mechanism 26 that is coupled to an electric eye sensor 28. From the feed rolls 18 and 20, the web 10 is blown within an area defined by a pair of parallel plates 30 and 32 by a blower 34. Almost all tension is removed from the web 10 as it floats in the area between the plates, balanced between its linear rate of travel and the flow of air from the blower 34.

From the accumulator area between the plates 30 and 32, the web 10 travels into an upright U-shaped support guide 36. The guide 36 acts to support the web 10 and to feed the web to the folding mechanism. The U-shaped guide 36 is supported by a vertical member 38 which may be raised by the action of a solenoid 40. Raising of the U-shaped guide 36 is initiated by the closing of contact within a counter switch 42 after the operator-selected number of folds have been allowed to trip the switch. The switch contact then actuates the solenoid 40, raising the U-shaped guide 36. This results in a $\frac{1}{8}$ to a $\frac{1}{4}$ inch upward projection of the web to simplify the bagging of identical numbers of pads.

Figure 2:
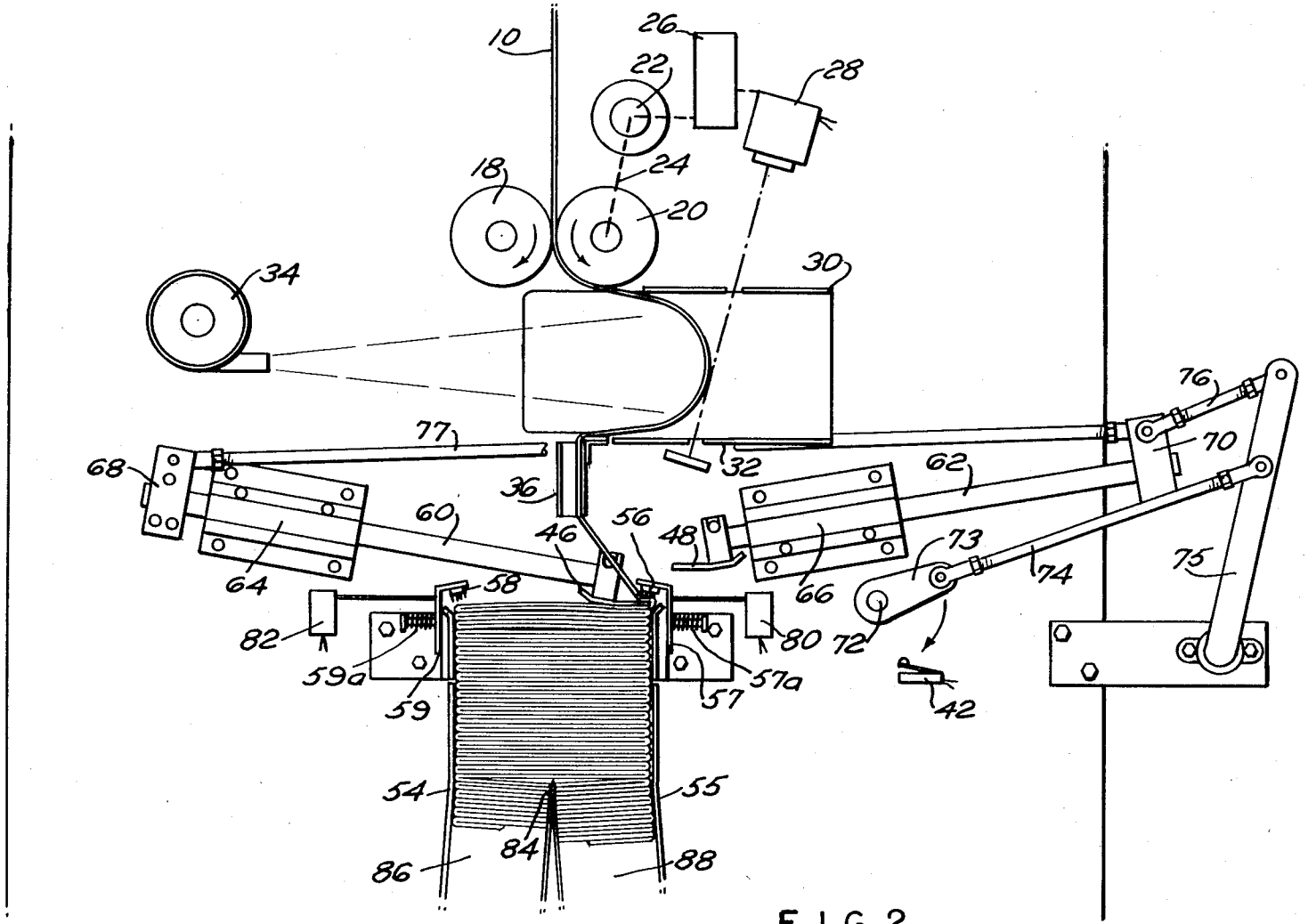
FIG. 2 is a top view of the mechanism by which the vertical web is advanced, air supported, and progressively folded in a tensionless state and finally pushed into a receiving trough where it is slit.
Figure 3:
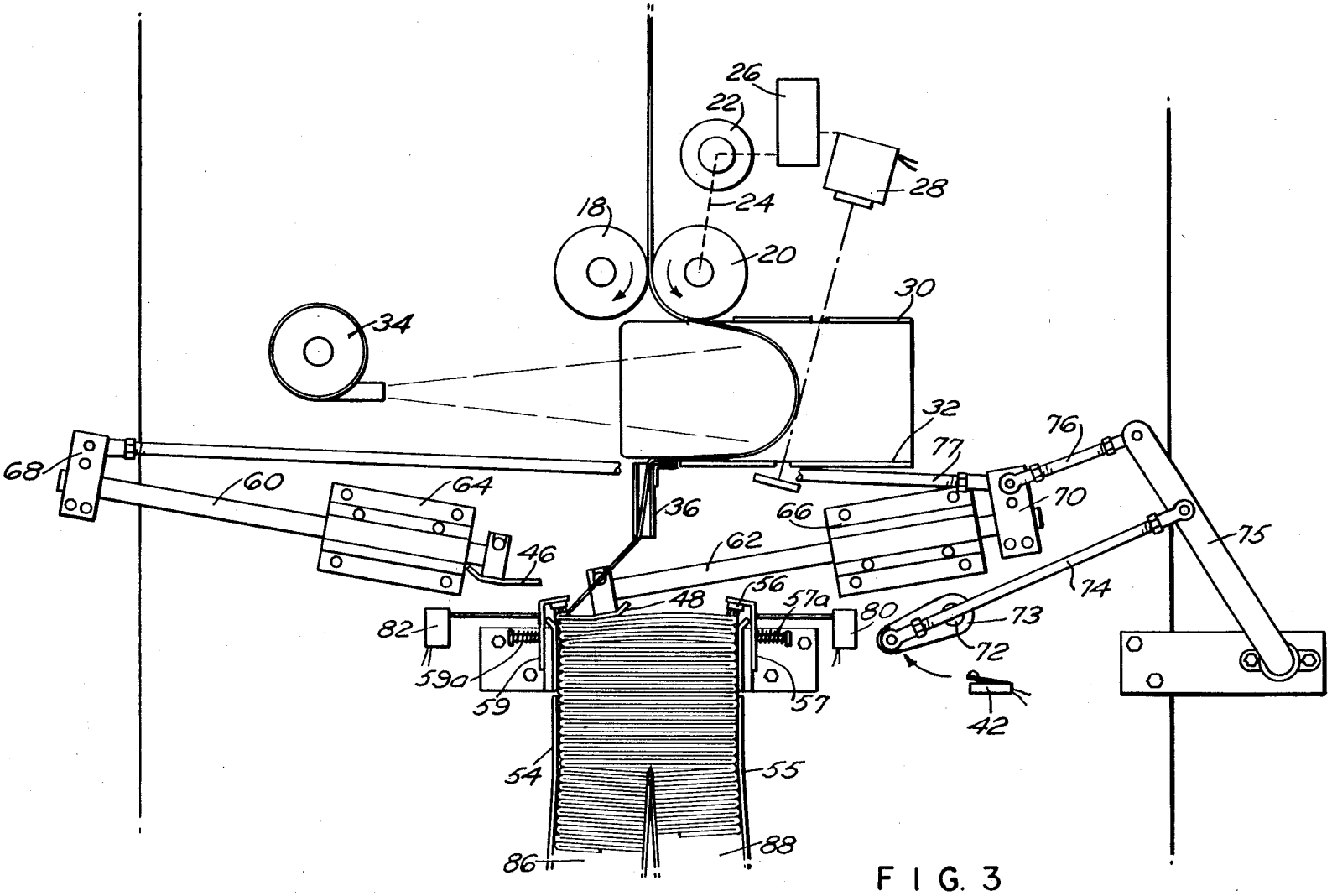
FIG. 3 is a similar top view to that of FIG. 2 showing the folding apparatus in a different attitude.

As the web leaves the guide 36, it is alternately pushed by folding blades 46, 48. As seen in FIG. 2, the blade 46 is at the end of its stroke where its position is determined by guide rollers 50, 51 (see FIG. 1B), which are secured to a bracket 52. This action prevents any deflection of the blade 46. A similar arrangement (not shown) is provided for blade 48. It will be seen that the web is folded in a trough defined by a pair of side plates 54, 55; and that as each folding plate 46, 48 folds the webs toward the side plates 54, 55 a new fold is caught under impaling means in the form of pins 56, 58 respectively. These pins are a multiplicity of flexible spring wires that resemble card clothing, which will retain the fold of the web in a position until the next reciprocation of the folding plate 46, 48, as the case may be.

The folding plates 46, 48 are mounted vertically on the ends of rods 60, 62 respectively. The rods are mounted in linear bearings 64, 66 respectively, and at the far ends of the rods away from the folding plates 46, 48, are clevis rod blocks 68, 70 respectively. Reciprocating motion to the rods 60 and 62 is imparted by the rotation of a shaft 72 to which is attached an eccentric 73 and an operating rod 74 that is in turn coupled to a rocker bar 75. From the rocker bar, adjustable operating arms 76 and 77 connect the two clevis rod blocks together for properly timed reciprocal motion. As a result, the folding plates 46, 48 always advance and retract in perfect synchronization, assuring precise repetition of the size of the selected fold.

It will be noted that the pin plates 56, 58 are mounted on spring plates 57, 59 respectively, that are loaded in inward direction by compression springs 57*a*, 59*a* respectively. Any bunching of the web material under the pin plates 56, 58 will force the support plates 57, 59 outwardly. The position of the plates is monitored by a pair of micro-switches 80, 82 which in turn are connected to all drive motor controls, including motor 22, so as to stop the mechanism before damage occurs.

As the repetition of the reciprocating motion increases the number of folds being pushed into the receiving trough defined by the plates 54, 55, the now accordion-pleated web is pushed against and past a knife-edged band saw blade 84, which as seen in FIG. 1B, is arranged on a conventional band saw generally designated 85. The operation of the blade then cuts the web into two separate groups of equally dimensioned four-ply pads. As the two sets of cut pads leave the saw blade 84, they pass into two diverging paths defined by a pair of trays generally designated 86, 88, which trays may be cantilevered so that the operator may push a pre-selected quantity into a pre-opened paper bag for offsite sealing, sterilizing and packaging.

I claim:

1. A method of folding gauze pads or the like comprising doubling a web of material by delivering a horizontal web into a vertical folding station moving continuously in a horizontal plane in a vertical attitude said web of material from said folding station into vertical feed rolls, driving the rolls, accumulating a length of the web material, maintaining an accumulated length of web material by directing air against the web, varying the speed of the feed rolls responsive to the accumulated length of web directing the web material into a vertically oriented U-shaped guide, moving the web under an impaling means and into a receiving tray by moving a plate onto the web, withdrawing the plate and simultaneously moving a second plate from the opposite side of the web onto the web under a second impaling means.

2. A machine for the continuous manufacture of gauze pads comprising means introducing a web into a work path in a horizontal plane, a vertically oriented folding bar means along said path to fold the web in half into a vertical attitude, vertically oriented guide means along said path to maintain the folded web in the vertical attitude, a drive motor, means comprising vertical nip rolls, along said work path and coupled to said drive motor to receive the folded web, a pair of parallel plates vertically oriented, laterally displaced, and transverse to the web in the path, a blower means located away from said plates and on the opposite side of the web in the path for blowing the web in between the plates, control means for determining nip roll speed said control means including sensing means along said path for sensing the depth of the web between the plates, and means for folding the web in accordion fashion, said folding means comprising a pair of folding plates along said path, means mechanically coupling said plates together for imparting alternating motion thereto whereby first one plate is moved into the web and as it withdraws the second plate is moved into the web and, an open ended receiving trough means associated with said plates for receiving the vertical folded web including impaling means located at each leading edge of said trough to grip the edges of the web at its folds.

* * * * *